US007971394B1

(12) United States Patent
Dowling et al.

(10) Patent No.: US 7,971,394 B1
(45) Date of Patent: Jul. 5, 2011

(54) ADJUSTABLE LOCK HEIGHT DOOR

(76) Inventors: Michael T Dowling, Chesterfield, MO (US); William D Johnson, Rogersville, MO (US)

( * ) Notice: Subject to any disclaimer, the term of this patent is extended or adjusted under 35 U.S.C. 154(b) by 0 days.

(21) Appl. No.: 11/956,716

(22) Filed: Dec. 14, 2007

Related U.S. Application Data

(60) Provisional application No. 60/885,799, filed on Jan. 19, 2007.

(51) Int. Cl.
*E06B 3/00* (2006.01)

(52) U.S. Cl. ..... 49/506

(58) Field of Classification Search ..... 49/506, 49/394, 395, 460, 461, 462; 292/340, 341, 292/341.14, 341.18, 341.19, DIG. 53, DIG. 54; 70/451, 461

See application file for complete search history.

(56) References Cited

U.S. PATENT DOCUMENTS

| | | | | | |
|---|---|---|---|---|---|
| 58,929 | A * | 10/1866 | Wood | 292/341.19 |
| 1,272,115 | A * | 7/1918 | Russell | 292/341.19 |
| 2,904,141 | A * | 9/1959 | Henrichs | 403/321 |
| 3,107,113 | A * | 10/1963 | Sconzo | 292/228 |
| D242,597 | S * | 12/1976 | Gamus | D8/343 |
| 4,139,999 | A * | 2/1979 | Allenbaugh | 70/452 |
| 4,305,611 | A * | 12/1981 | Robins | 292/238 |
| 4,852,918 | A * | 8/1989 | Allen | 292/169 |
| 5,634,508 | A * | 6/1997 | Herbst | 160/371 |
| 5,762,387 | A * | 6/1998 | Edgerly et al. | 292/357 |
| 5,809,698 | A * | 9/1998 | Mori | 49/506 |
| 6,128,933 | A * | 10/2000 | Mirshafiee et al. | 70/107 |
| 6,592,156 | B2 * | 7/2003 | Levine | 292/23 |
| 7,121,531 | B1 * | 10/2006 | Gonzalez | 256/73 |
| 7,207,608 | B2 * | 4/2007 | Monts de Oca | 292/341.18 |
| 7,571,941 | B2 * | 8/2009 | Chang | 292/347 |
| 2005/0127692 | A1 * | 6/2005 | Sanders | 292/340 |

* cited by examiner

*Primary Examiner* — Katherine Mitchell
*Assistant Examiner* — Catherine A Kelly

(57) ABSTRACT

A replacement door having an adjustable locking mechanism that can be used to replace any number of doors employing locking mechanisms positioned at different heights. The locking mechanism, including a handle and plunger mechanism is engaged in the edge of the door and moveable up and down along a vertical path so as to adjust the height at which the plunger engages a preexisting opening in the door frame. When the mechanism is positioned at the desired height a wrap plate secures the mechanism in place. The replacement door may include a continuous hinge that can align with any hinge apparatus on the door frame.

4 Claims, 6 Drawing Sheets

4 1/2" HINGE & STRIKE COMPARISON - 1 3/4"

| | | | | | | | | | |
|---|---|---|---|---|---|---|---|---|---|
| AMWELD | | C4 = 39 9/16"<br>MB = 39 3/16" | | | 9 5/8" | 5/16" | 3/16" | 1/16" | 1/8" |
| BENCHMARK | | C4 = 39 9/16"<br>MB = 39 3/16" | | | 7 1/8" | 11/32" | 1/4" | 1/8" | 3/32" |
| CECO | | C4 = 41 1/16"<br>MB = 40 11/16" | 8 1/4" | | 8 7/8" | 5/16" | 1/4" | 1/8" | 1/16" |
| COPCO | | C4 = 39 9/16"<br>MB = 39 3/16" | 9 5/8" | | | | 7/32" | | |
| CURRIES | | C4 = 39 1/4"<br>MB = 38 7/8" | | | 7 1/8" | 5/16" | 1/4" | | |
| DEANSTEEL | | C4 = 39 9/16"<br>MB = 39 3/16" | 11 1/2" | | 7 1/8" | 5/16" | 1/4" | 1/8" | 1/16" |
| KEWANEE | | C4 = 39 9/16"<br>MB = 39 3/16" | 9 1/2" | | 9 1/2" | 3/8" | 1/4" | 1/16" | 1/3" |
| MESKER | | C4 = 39 9/16"<br>MB = 39 3/16" | | | 7 1/8" | 5/16" | 1/4" | 1/8" | 1/16" |
| PIONEER | | C4 = 371/4"<br>MB = 36 7/8" | | | 7 1/8" | 5/16" | 7/32" | 3/32" | 3/32" |
| REPUBLIC | 6'-8"<br>6'-10"<br>7'-0"<br>7'-2"<br>7'-4"<br>7-6"<br>7'-8"<br>7'-10"<br>8'-0" | C4 = 39 9/16"<br>MB = 39 3/16" | 9 5/8"<br>11 1/2"<br>11 5/8"<br>11 5/8"<br>11 1/2"<br>11 1/2"<br>11 5/8"<br>11 3/8"<br>11 1/2" | 2 @ 29 15/16"<br>2 @ 31 1/4"<br>2 @ 29 15/16<br>2 @ 30 15/16"<br>2 @ 34 1/4"<br>2 @ 35 1/4"<br>3 @ 24 1/8"<br>3 @ 24 7/8"<br>3 @ 25 1/2" | 9 5/8"<br>7 1/8"<br>11 5/8"<br>11 5/8"<br>7 1/8"<br>7 1/8"<br>7 1/8"<br>7 1/8"<br>7 1/8" | 5/16" | 1/4" | 1/8" | 1/16" |
| STEELCRAFT | 6'-8"<br>6'-10"<br>7'-0"<br>7'-2"<br>7'-4"<br>7-6"<br>7'-8"<br>7'-10"<br>8'-0" | C4 = 39 9/16"<br>MB = 39 3/16" | 9 5/8" | 2 @ 29 15/16"<br>2 @ 30 15/16"<br>2 @ 31 15/16"<br>2 @ 32 15/16"<br>2 @ 33 15/16"<br>2 @ 34 15/16"<br>3 @ 23 51/64"<br>3 @ 24 5/8"<br>3 @ 25 19/64" | 9 5/8" | 5/16" | 1/4" | 1/8" | 1/16" |

Fig. 6A

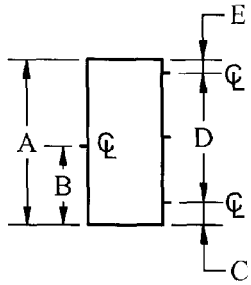

NOTE: Dimension "B" is shown for a Standard Cylindrical Preparation

Subtract 3/8" from Dimension "B"for a Standard Mortise Preparation.

Dimensions in Parenthesis ( ) are Top to Top of 1st hinge.

Fig. 6B

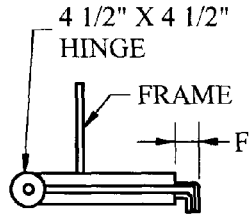

Fig. 6C

ADJUSTABLE LOCK HEIGHT DOOR

CROSS REFERENCE TO RELATED APPLICATIONS

This application claims the benefit of provisional application Ser. No. 60/885,799, filed Jan. 19, 2007, and which is incorporated herein by reference.

BACKGROUND OF THE INVENTION

The invention relates generally to doors and more particularly to a door in which the height of the locking mechanism can be adjusted. Generally speaking entry doors are constructed similarly. That is, the door has at least two hinges one edge which matingly engage hinge apparatus on the door frame and the locking mechanism on the opposite edge. The locking mechanism generally consists of a handle actuated plunger that engages an opening in the door frame to secure or lock the door in a closed position. The height from the floor at which the plunger strikes the door frame and engages an opening therein is referred to as the lock height. This is measured in inches. The lock height for commonly installed doors ranges from 36 to 40 inches, generally 36⅞ inches to 39 3/16 inches, depending upon the brand of door. Similarly, the placement of the hinges along the length of the door edge can vary from door to door.

If a door requires replacement, it generally is necessary to replace it with the same brand of original equipment door so that the hinge apparatus align and lock height is the same. This requires a door supplier or contractor to carry a substantial number of replacement doors.

It would be advantageous to have a door that had a hinge apparatus that can engage any original hinge structures on preexisting door frame and apparatus for adjusting the height of the locking mechanism so that one door can be used to replace any number of doors.

SUMMARY OF THE INVENTION

In one aspect of the invention a replacement door is provided having an adjustable locking mechanism that can be used to replace any number of doors employing locking mechanisms having different lock heights. In general, the locking mechanism includes the handle and plunger mechanism slidingly engaged in the edge of the door and moveable up and down along a vertical path so as to adjust the height at which the plunger engages a preexisting opening in the door frame. When the mechanism is positioned at the desired or predetermined lock height the locking mechanism is secured in place.

In another aspect of the invention the replacement door includes a continuous hinge that can align with any hinge apparatus on the door frame.

BRIEF DESCRIPTION OF THE DRAWINGS

FIG. 5 is a perspective view of another embodiment of an adjustable height locking mechanism for a door and FIG. 6A is a table showing various hinge positions and lock heights for a number of commonly employed original equipment doors;

FIG. 6B shows a front view of a hinge plate with dimensions for various commonly employed original equipment doors; and FIG. 6C shows a top plane of the hinge plate with dimensions for various commonly employed original equipment doors.

DETAILED DESCRIPTION

Figure 1:
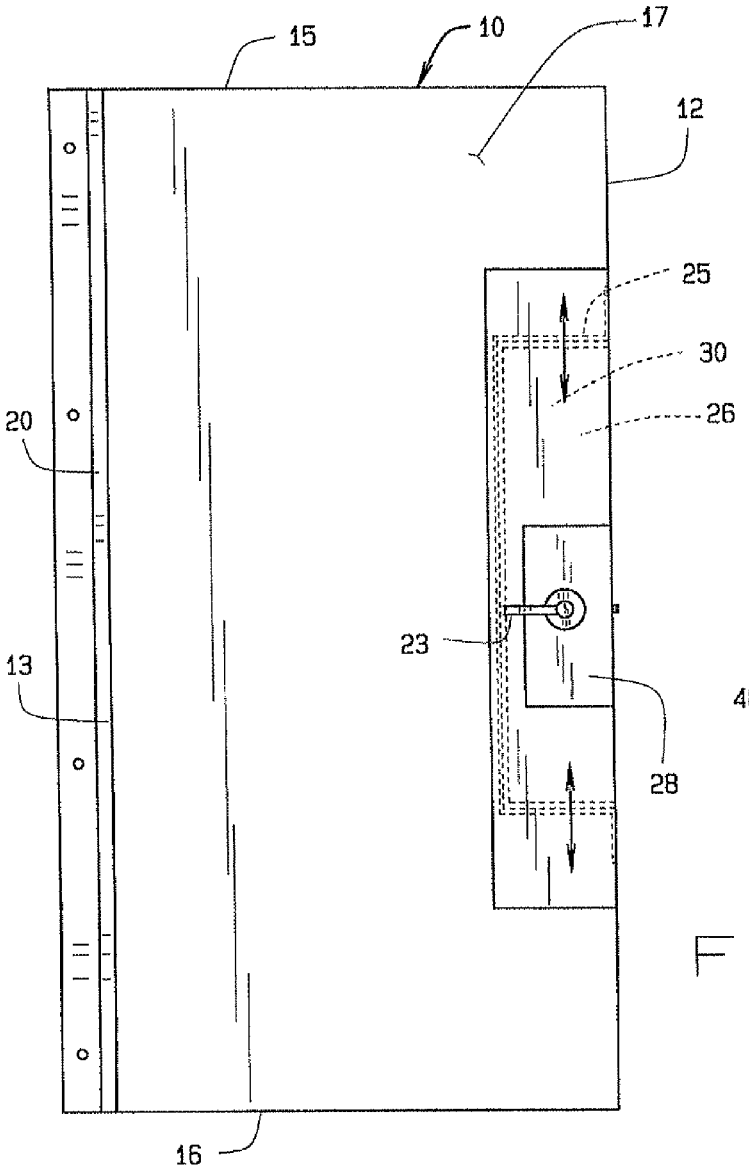
FIG. 1 is a plan view of a door of the present invention

What is described, in general is a replacement door having an adjustable locking mechanism that can be used to replace any number of doors employing locking mechanisms with different lock heights. In one aspect, the locking mechanism includes a handle and plunger mechanism slidingly engaged in the edge of the door and moveable up and down along a vertical path so as to adjust the height at which the plunger engages a preexisting opening in the door frame. When the locking mechanism is positioned at the desired lock height the locking mechanism is secured in place, usually by a wrap plate which is secured to the edge of the door.

In another aspect, the locking mechanism is associated with a locking mechanism bracket. The door includes an elongated cavity adjacent one edge. The locking mechanism bracket is posited in the cavity so that it can be moved up and down within the cavity. A wrap plate is affixed to the exterior of the door to secure the locking mechanism bracket and associated locking mechanism at a desired height.

In another aspect of the invention, there is a liner frame in the cavity and the locking mechanism bracket is positioned inside the bracket.

In another aspect of the invention the replacement door includes a continuous hinge that can align with any hinge apparatus on the door frame.

A door employing an adjustable height locking mechanisms is indicated in the drawings by reference numeral 10. Door 10 is a conventional rectangular door having opposed vertical edges 12 and 13, a horizontal top edge 15 and a bottom edge 16. It will be appreciated that door 10 can be a metal door or wood door having an appreciable material thickness between a first planar side 17 and a second planar side 18. The door can be hollow, solid or hollow filled with a material such as Styrofoam or the like. In any event, the planar sides function as front and back surfaces of the door. In the illustrated orientation, door 10 has a continuous hinge 20 that extends substantially the entire length of edge 13.

Door 10 includes locking apparatus, indicated generally by reference numeral 22, mounted in edge 14. Locking apparatus 22 may include what is referred to as a locking mechanism, which generally comprises a conventional handle 23 and plunger 24 assembly. Operation of a handle 23 actuates the plunger in an out so that the plunger can engage or be disengaged from an opening in the door frame. In one aspect of the invention locking apparatus 22 includes major components such as the handle 23, plunger, a liner frame 25 with flanges 25F, a locking mechanism bracket 26 and a wrap plate 28.

Figure 3:
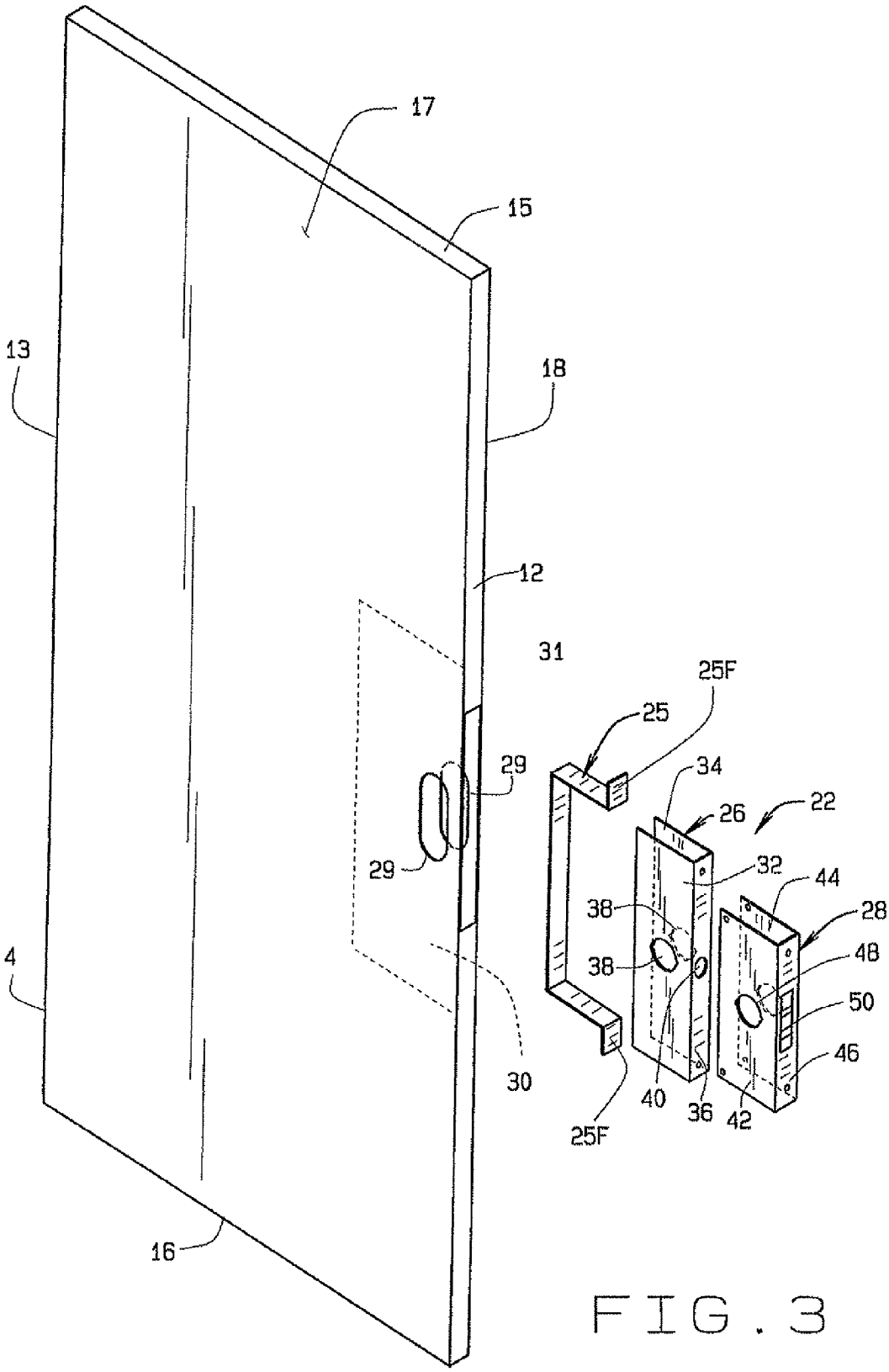
FIG. 3 is a perspective view of a door of the present invention with an exploded view of the adjustable height locking mechanism.
Figure 4:
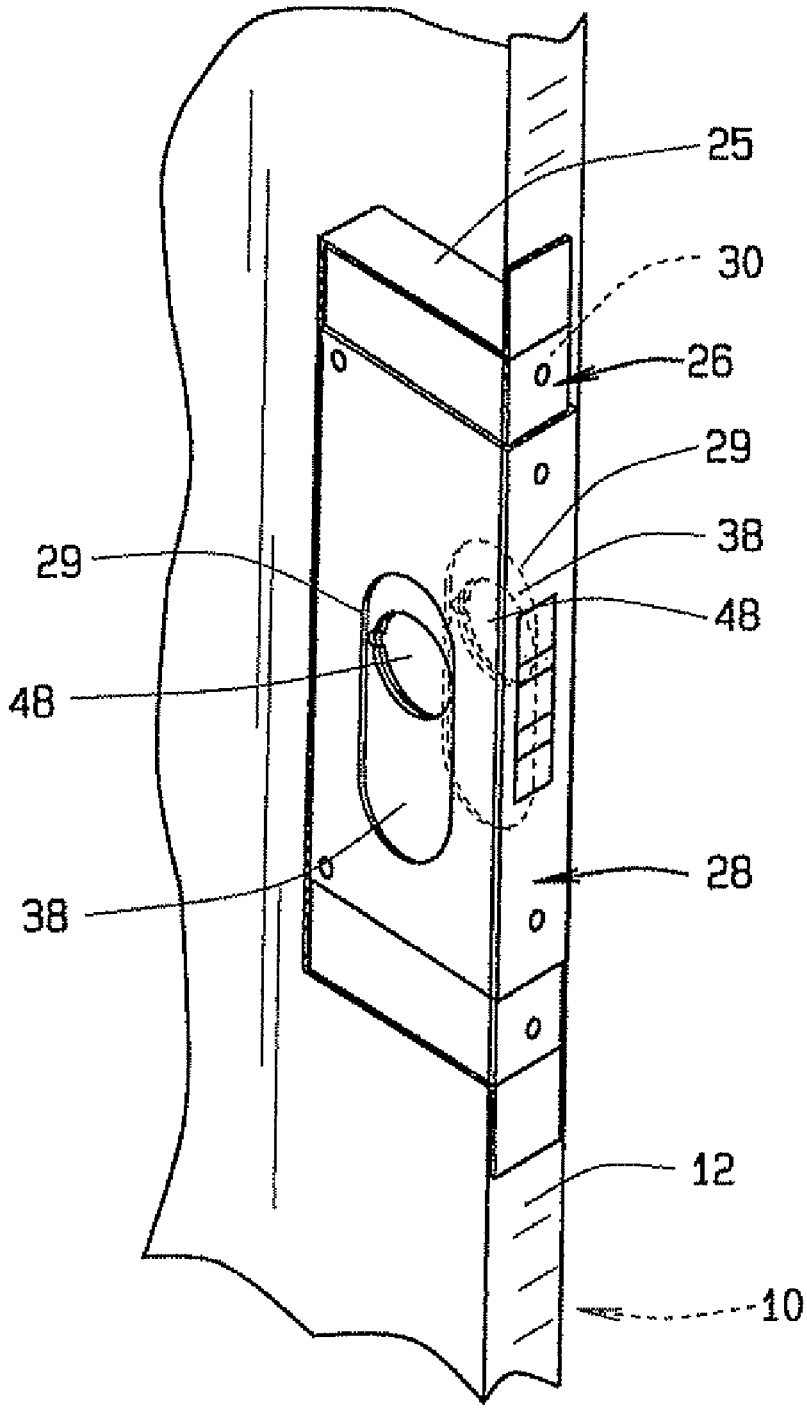
FIG. 4 is another perspective view of the adjustable height locking mechanism with the components exposed.

It will be understood that in one aspect of the invention that if the door is solid or filled, the door includes an elongated rectangular internal cavity 30 adjacent front edge 14 with an elongated plunger opening 31 to the front edge 14. As shown in FIGS. 3 and 4, the front and back surfaces of door 10 include parallel substantially, elongated openings 29 into cavity 30 that allow door handles 23 to extend out of the surface of the door at any desired height along the vertical length of the openings 29.

In an embodiment illustrated in FIGS. 1 through 4, frame 25 is positioned in the cavity 30 and in general provides a liner or framework positioned in the cavity. It will be noted that cavity 30 is longer than frame 25 so that the vertical position of frame can be adjusted in height inside the cavity and fastened in place to the inside of edge 14 with attachment apparatus, such as screws, bolts or the like through flanges 25F. If door 10 is hollow, frame 25 will be secured inside the door so that it cooperates with an opening 31. In any event, locking mechanism bracket 26 is positioned in frame 25. In one aspect of the invention, bracket 26 can move up and down within frame 25 to a predetermined or desired height relative to the door and door frame. Bracket 26 is a substantially rectangular having U-shaped cross section with opposed side walls 32, 34 and a front wall 36. There are complementary openings 38 in side walls 32, 34 that correspond to elongated openings 29 and an opening 40 in the front wall that will correspond to opening 31.

It will be appreciated by one skilled in the art that a door lock mechanism having door handles, plunger and working mechanism can be mounted in bracket 26. The door handles 23 would be attached to the working mechanism and extend out through openings 38 and a plunger would be positioned to extend and retract through front opening 40 when actuated by a handle. With bracket 26 and door lock mechanism positioned in cavity 30, the door handles would extend out through elongated openings 29 in the door surfaces.

Figure 2:
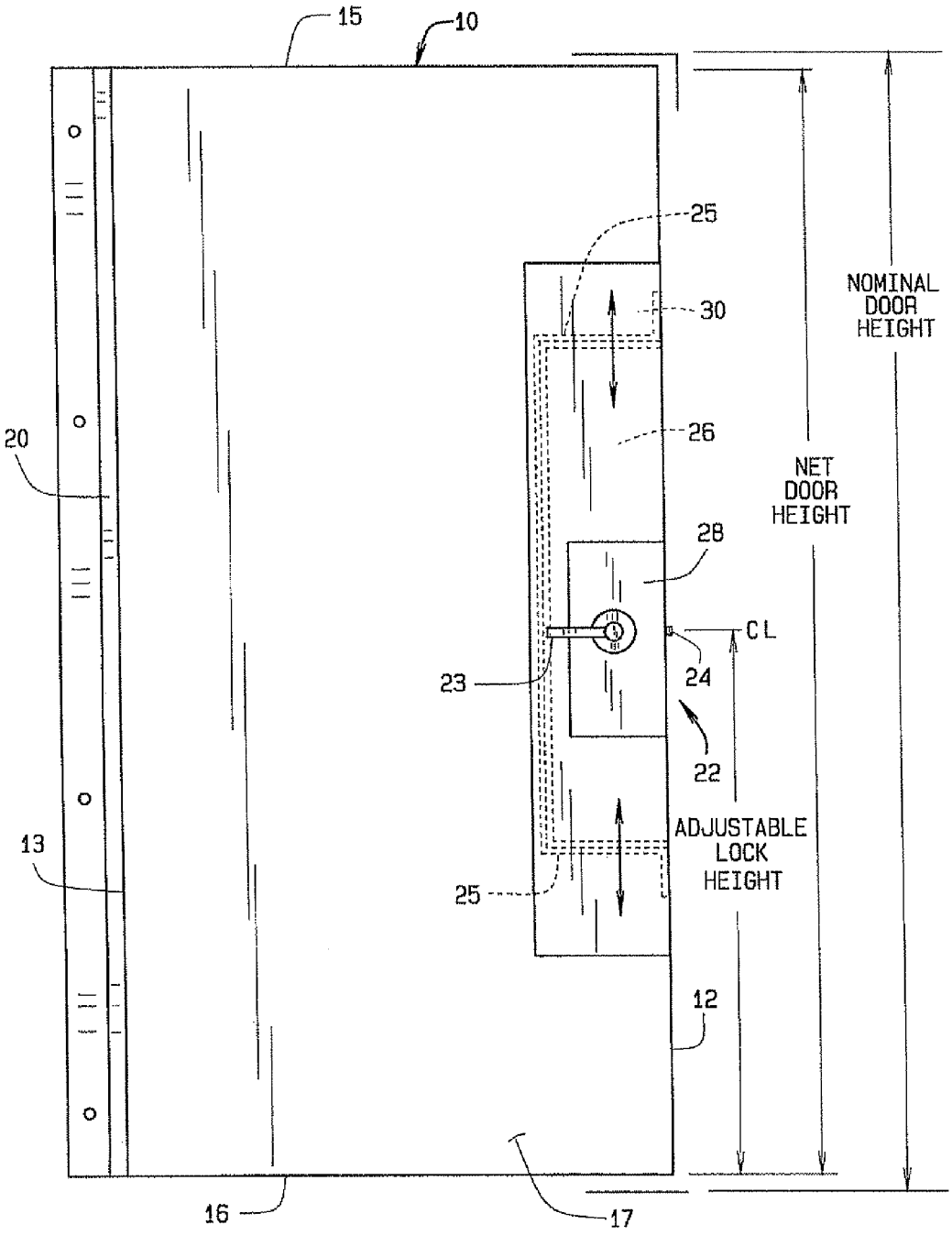
FIG. 2 is another plan view of a door of the present invention.

In any event frame 25 can be moved up and down within cavity 30 and bracket 26 can be moved up and down inside frame 25, as shown by the arrows in FIG. 2, until the locking mechanism is positioned at the appropriate lock height CL. Because openings 29 in the door sides are elongated, the door handles 23 can extend out of the door at any desired height.

Figure 1A:
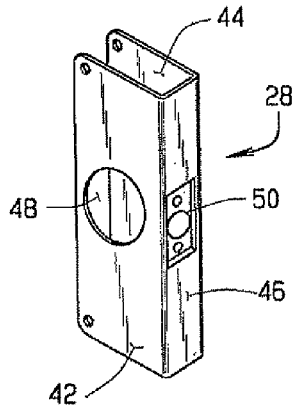
FIG. 1A is a wrap plate.

Wrap plate 28 is shown in FIG. 1A. Wrap plate 28 has a substantially rectangular U-shaped cross-sectional configuration with side walls 42, 44 and front wall 46. There are complementary openings 48 in the side walls and an opening 50 in the front wall. As shown, wrap plate 28 can be positioned over the edge of the door and bracket 26 when the bracket and locking mechanism are positioned at the desired height. The door handles can protrude through openings 48 and the plunger through opening 50. Wrap plate 28 can be secured the door with screws or other appropriate attachment apparatus to hold bracket 26 in place at the appropriate height. When the wrap plate is secured in place, the locking mechanism is secured at a desired or predetermined lock height.

It will be appreciated that in certain constructions of the door, for example if the door is substantially solid and there is a void or cavity, such as cavity 30 formed in the door, the bracket 26 can be positioned within a cavity without the use of a frame. The bracket 26 can be moved up and down within the cavity until it is positioned at a desired height and then secured in place at that height by use of a wrap plate 28.

Figure 5:
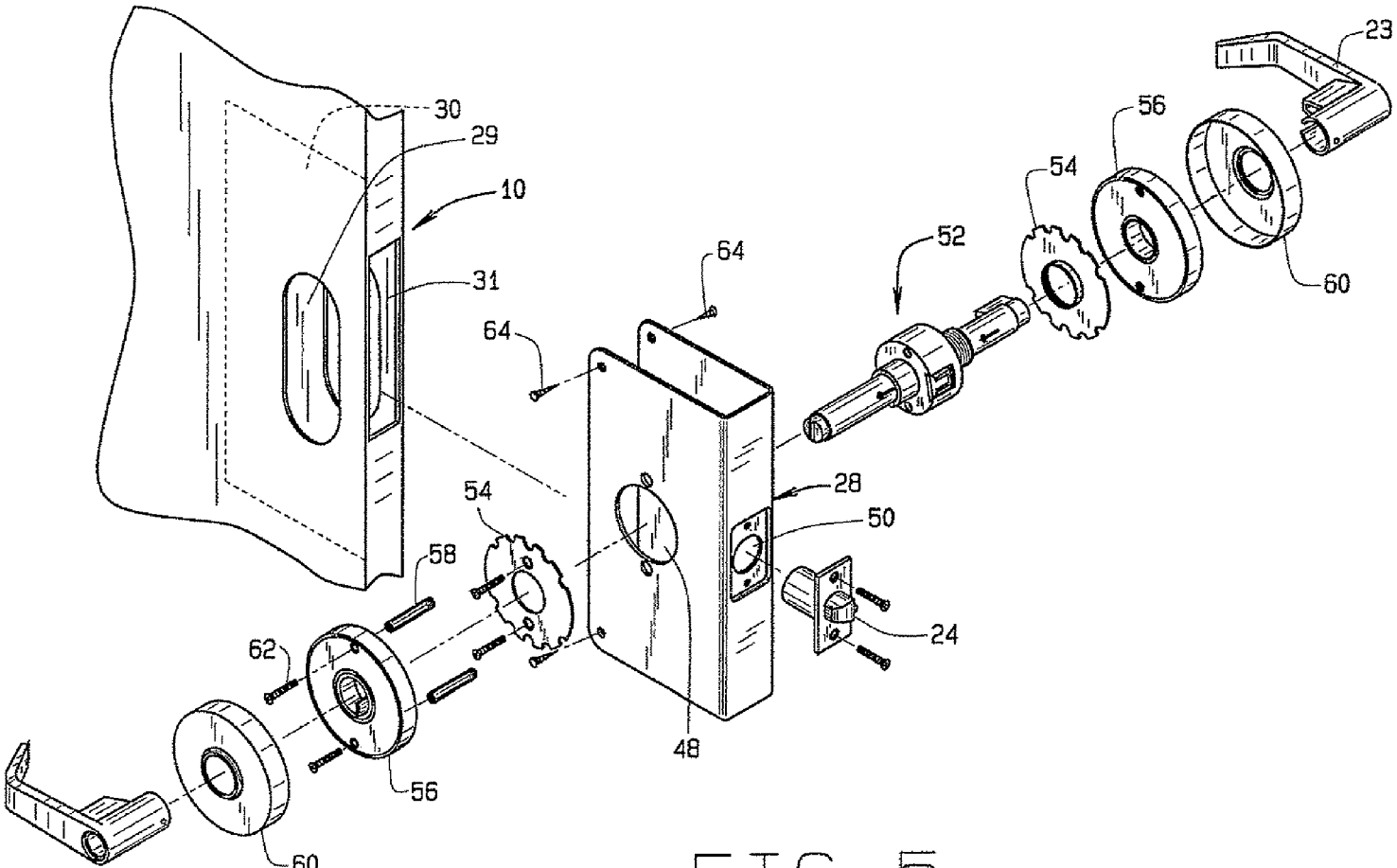

Another aspect of the invention is shown in FIG. 5. A door 10 with a front edge 14 includes an inner space, either because the door is hollow or there is a cavity 30, with elongated openings 29 in the outer surfaces and an elongated opening in front edge 14. A wrap plate 28 configured substantially similar to the wrap plate 28 described above. FIG. 5 includes a more detailed illustration of a locking mechanism, comprising a shaft 52 that actuates a plunger 24 through handles 23. Shaft 52 extends through openings 48 and secured in place in wrap plate 28 by conventional mounting hardware. The locking mechanism can be constructed in any acceptable manner. The example shown includes the shaft 52, plunger 24, securing plates 54, spring assemblies 56, spacers 58 outer covers 60 and the handles 23. The various components are secured in place by a plurality of screws 62 to secure the locking mechanism within the wrap plate 28. In use, shaft 52 would be positioned inside the door so that the ends of the shafts extend out of openings 29 on each side of the door. Wrap place 28 would be positioned over the edge of the door and openings 48 aligned with openings 29. The various components of the locking mechanism would be assembled and secured so that the entire locking mechanism is in place inside the door and the wrap plate. The wrap plate 28 and associated locking mechanism then can be moved up and down until plunger 24 is positioned at the appropriate predetermined lock height CL (FIG. 2) to engage an opening in the door frame. Fastening devices, for example, screws 64 are introduced through screw holes 66 in the wrap plate on each side of the wrap plate to secure the wrap plate and associated locking mechanism in place on the door at the desired or predetermined lock height.

It will be understood that a door employing an adjustable height locking mechanism and continuous hinge 20 as described herein can be used to replace any conventional original equipment door. The continuous hinge will mate with hinge apparatus located at any position along the vertical height of a door frame corresponding edge 13 of the door. Hence a supplier or contractor would only need to carry one door to replace any number or original equipment doors.

Table 1, below shown in FIG. 6A, is a chart showing various hinge positions and lock heights for a number of commonly employed original equipment doors.

It will be understood that the foregoing written description and accompanying drawings are intended to be illustrative only and should not be construed in a limited sense.

The invention claimed is:

1. A method of setting the height of a door locking mechanism at a desired height relative to a door and a door frame, the door having first and second vertical side edges, a front face and a back face separated by a thickness, and a lock cavity in the door thickness adjacent one of the vertical edges, the cavity opening to the adjacent one of the vertical edges and to aligned elongate slots in the front and back faces, and the door locking mechanism being disposed in the lock cavity and having a retractable plunger extending through the opening in the adjacent one of the vertical edge, and a working mechanism aligned with the aligned elongate slots in the front and back faces of the door to allow handles to be connected to the working mechanism to actuate the plunger, the method comprising:

moving the locking mechanism and a generally U-shaped wrap plate extending around the front face, the adjacent one of the vertical edges, and the back face of the door, the wrap plate having an opening through which the plunger of the locking mechanism extends, and the portions of the wrap plate overlying the front and back faces having openings aligned with the working mechanism of the locking mechanism to allow the handles to be connected to the working mechanism, up or down to a desired height relative to the door and the door frame, with the working mechanism of the locking mechanism remaining aligned with the aligned slots in the front and back faces of the door, and the wrap plate covering the portions of the aligned slots not aligned with the working mechanism of the lock mechanism; and securing the wrap plate to the door to secure the locking mechanism at the desired height.

2. The method of claim 1 wherein said door frame has a lock receiving opening therein and wherein the step of moving the locking mechanism and the wrap plate up or down to a desired height relative to the door and the door frame further comprises moving the locking mechanism and the wrap plate up and down until said locking mechanism is in functional alignment with the lock receiving opening in the door frame.

3. The method of claim 1 wherein said locking mechanism includes a frame moveably engaged in the lock cavity and wherein the step of moving the locking mechanism and the wrap plate up or down to a desired height relative to the door the door frame further comprises moving the locking mechanism and the frame and the wrap plate up or down to a desired height relative to the door and the door frame.

4. A method of replacing an original door with a replacement door having an adjustable height lock comprising:

disengaging an original door from door hinge elements secured to a first vertical side member of a door frame;

positioning a replacement door in the door frame, said replacement door having front and back faces with a material thickness therebetween and with a first vertical edge and a second vertical edge and a continuous hinge element extending the critical length of the first vertical edge of the replacement door, and a lock cavity disposed adjacent the second vertical edge of the replacement door, the lock cavity opening to the second vertical edge and to aligned elongate slots in the front and back faces of the door;

positioning said continuous hinge element adjacent the door hinge elements secured to the first vertical side door frame member;

engaging said continuous hinge element with the door hinge elements secured to the first door vertical side frame member and hingedly attaching said continuous hinge element to said door hinge elements;

positioning the second vertical edge of the replacement door adjacent a second vertical side member of the door frame, said second vertical door frame member having an opening therein for receiving a plunger of a door lock mechanism disposed in the lock cavity in the door;

moving the locking mechanism disposed in the lock cavity and the retractable plunger extending through the opening in the second vertical edge, and a working mechanism aligned with the aligned elongate slots in the front and back faces of the door to allow handles to be connected to the working mechanism to actuate the plunger and a wrap plate extending around the front face, the second vertical edge, and the back face of the door, the wrap plate having an opening through which the plunger of the locking mechanism extends, and the portions of the wrap plate overlying the front and back faces having openings aligned with the working mechanism of the locking mechanism to allow the handles to be connected to the working mechanism, up or down to a desired height relative to the second vertical door frame member;

aligning the lock mechanism plunger with the plunger receiving opening in the second vertical door frame member; and securing the wrap plate to the door to secure the locking mechanism and the plunger in alignment with the plunger opening in the second vertical door frame member, with the working mechanism of the locking mechanism remaining aligned with the aligned slots in the front and back faces of the door, and the wrap plate covering the portions of the aligned slots not aligned with the working mechanism of the lock mechanism; and securing the wrap plate to the door to secure the locking mechanism at the desired height.

* * * * *